US010343253B2

(12) United States Patent
Bello et al.

(10) Patent No.: US 10,343,253 B2
(45) Date of Patent: Jul. 9, 2019

(54) METHODS AND SYSTEMS FOR CHEMICAL MECHANICAL PLANARIZATION ENDPOINT DETECTION USING AN ALTERNATING CURRENT REFERENCE SIGNAL

(71) Applicant: GLOBALFOUNDRIES, Inc., Grand Cayman (KY)

(72) Inventors: Abner Bello, Clifton Park, NY (US); Michael Wedlake, Austin, TX (US)

(73) Assignee: GLOBALFOUNDRIES, INC., Grand Cayman (KY)

( * ) Notice: Subject to any disclaimer, the term of this patent is extended or adjusted under 35 U.S.C. 154(b) by 841 days.

(21) Appl. No.: 14/311,761

(22) Filed: Jun. 23, 2014

(65) Prior Publication Data

US 2015/0371912 A1 Dec. 24, 2015

(51) Int. Cl.
*B24B 37/04* (2012.01)
*B24B 37/27* (2012.01)
*B24B 37/005* (2012.01)

(52) U.S. Cl.
CPC ..... *B24B 37/04* (2013.01); *B24B 37/005* (2013.01); *B24B 37/27* (2013.01)

(58) Field of Classification Search
None
See application file for complete search history.

(56) References Cited

U.S. PATENT DOCUMENTS 5,240,552 A * 8/1993 Yu ..... B24B 37/04 257/E21.244
5,700,180 A * 12/1997 Sandhu ..... B23Q 15/013 451/21
6,179,688 B1 * 1/2001 Beckage ..... B24B 37/013 451/10
2002/0173223 A1 * 11/2002 Gitis ..... B24B 37/013 451/5
2003/0087586 A1 * 5/2003 Kaushal ..... B24B 37/013 451/8
2011/0199031 A1 * 8/2011 Balazovic ..... H02P 23/14 318/400.33

* cited by examiner

*Primary Examiner* — Allan W. Olsen
*Assistant Examiner* — Margaret D Klunk
(74) *Attorney, Agent, or Firm* — Lorenz & Kopf, LLP

(57) ABSTRACT

Methods, non-transitory computer readable media, and systems are provided for detecting an endpoint of a chemical mechanical planarization (CMP) process on a semiconductor substrate. The method comprises generating a reference signal, generating a first signal with which to control a CMP system, generating a second signal using a combination of the first signal and the reference signal, commanding the CMP system with the second signal, generating a response signal that indicates an operational characteristic of the CMP system that is responsive to the second signal and a friction property of the semiconductor substrate, and filtering the response signal using the reference signal to determine the endpoint of the CMP process.

8 Claims, 2 Drawing Sheets

METHODS AND SYSTEMS FOR CHEMICAL MECHANICAL PLANARIZATION ENDPOINT DETECTION USING AN ALTERNATING CURRENT REFERENCE SIGNAL

TECHNICAL FIELD

Embodiments of the present disclosure are generally directed to methods and systems for chemical mechanical planarization endpoint detection. More particularly, embodiments of the present disclosure are directed to methods and systems for chemical mechanical planarization endpoint detection using a reference signal.

BACKGROUND

In the global market, manufacturers of mass-produced products must offer high quality products at a low price. It is thus important to maximize yield and process efficiency to minimize production costs. This holds especially true in the field of semiconductor fabrication, where it is essential to combine cutting-edge technology with volume production techniques. It is the goal of semiconductor manufacturers to reduce the consumption of raw materials and consumables while at the same time improving process tool utilization.

Chemical Mechanical Planarization (CMP) is a critical unit process for manufacturing of microelectronic and nanoelectronic devices. CMP typically utilizes mechanical abrasion and chemical reactions to remove portions of a semiconductor substrate. For example, CMP is traditionally accomplished by a polishing pad interacting with the semiconductor substrate in the presence of a polishing fluid. The polishing fluid is generally composed of abrasives and other molecular components.

The point at which the CMP process has removed the desired amount of material is commonly referred to as the endpoint of the CMP process. For many processes, this endpoint is reached when portions of an underlying material are exposed by the CMP process. This endpoint is often estimated to be reached after a predefined amount of time at which the semiconductor substrate is exposed to the CMP process. The variability of such set time endpoint detection, however, is often quite high due to changes in polishing pad conditions, variation in the slurry, and variation of incoming thicknesses of material to be removed. Such variation increases tolerances achieved and decreases yield.

Accordingly, it is desirable to provide improved methods and systems for CMP endpoint detection during semiconductor device fabrication. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Methods, non-transitory computer readable mediums, and controllers are provided for detecting an endpoint of a chemical mechanical planarization (CMP) process on a semiconductor substrate. In an embodiment, a method is provided for detecting an endpoint of a chemical mechanical planarization (CMP) process on a semiconductor substrate. The method comprises generating a reference signal, generating a first signal with which to control a CMP system, generating a second signal using a combination of the first signal and the reference signal, commanding the CMP system with the second signal, generating a response signal that indicates an operational characteristic of the CMP system that is responsive to the second signal and a friction property of the semiconductor substrate, and filtering the response signal using the reference signal to determine the endpoint of the CMP process.

In another embodiment, a non-transitory computer readable medium is provided for operating a processor during a chemical mechanical planarization (CMP) process on a semiconductor substrate. The non-transitory computer readable medium comprises instructions for generating a reference signal, generating a first signal with which to control a CMP system, generating a second signal using a combination of the first signal and the reference signal, commanding the CMP system with the second signal, generating a response signal that indicates an operational characteristic of the CMP system that is responsive to the second signal and a friction property of the semiconductor substrate, and filtering the response signal using the reference signal to determine an endpoint of the CMP process.

In another embodiment, a chemical mechanical planarization (CMP) system is provided. The CMP system includes a polishing head for securing a semiconductor substrate, a polishing platen opposing the polishing head and securing a polishing pad, a motor coupled with at least one of the polishing head and the polishing platen, and a controller. The controller comprises instructions configured for generating a reference signal, generating a first signal with which to control the motor, generating a second signal using a combination of the first signal and the reference signal, commanding the motor with the second signal, generating a response signal that indicates an operational characteristic of the CMP system that is responsive to the second signal and a friction property of a semiconductor substrate, filtering the response signal using the reference signal to determine an endpoint of the CMP process.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Embodiments of the present disclosure provide methods, non-transitory computer readable mediums, and Chemical Mechanical Planarization (CMP) systems during semiconductor fabrication. The methods, non-transitory computer readable media, and systems filter noise from a sensor signal using a reference signal. The reference signal is combined with a command signal to the CMP system, and the sensor signal varies in response to the reference signal component of the combined signal used to control the CMP system. The variation due to the reference signal may be used to provide reliable detection of velocity changes or other characteristics of the CMP system that vary due to an underlying material with different friction properties being uncovered by the CMP process.

Figure 1:
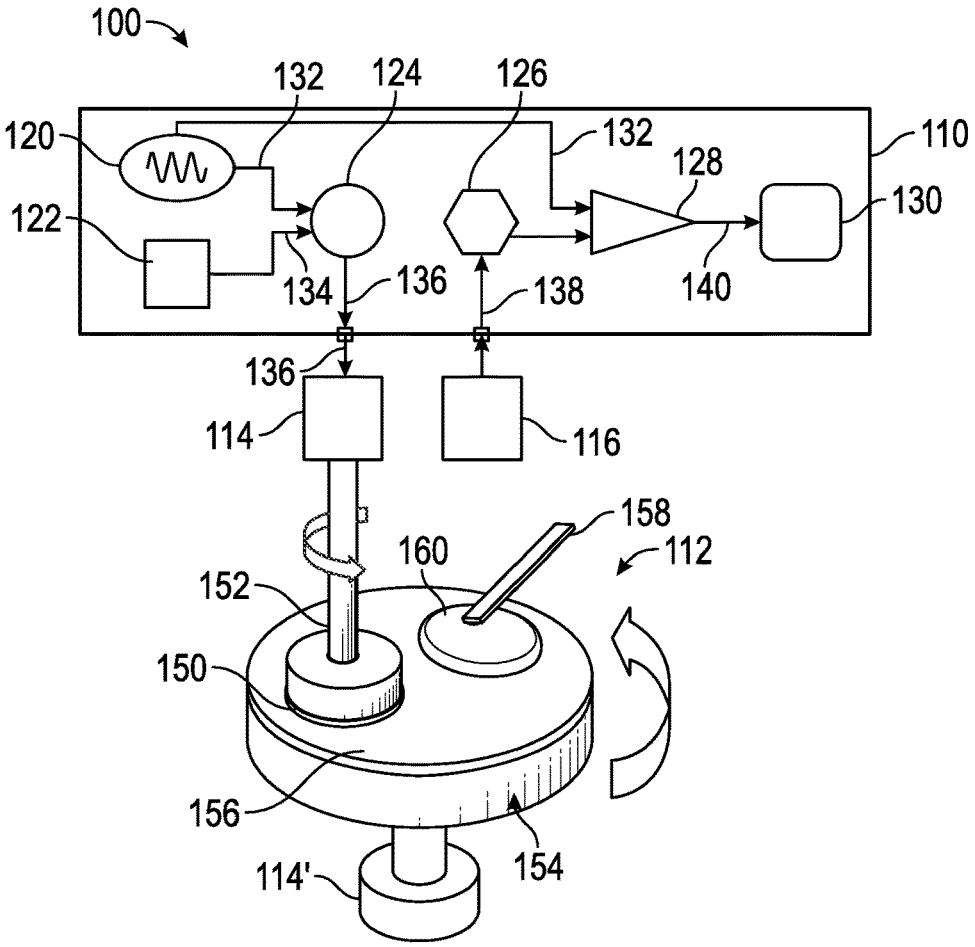
FIG. 1 is a simplified diagram of a chemical mechanical planarization (CMP) system in accordance with various embodiments.

Referring now to FIG. 1, a Chemical Mechanical Planarization (CMP) system 100 is illustrated in accordance with some embodiments. CMP system 100 includes a controller 110, a polishing assembly 112, a motor 114, and a response sensor 116. It should be appreciated that CMP system 100 may have additional and/or alternative components without departing from the scope of the present disclosure.

Controller 110 may include any control circuitry capable of performing the various tasks described below. For example, controller 110 may be a processor, such as a microprocessor, microcontroller, or digital signal processor (DSP), having the capability to execute instructions directing the processor to perform the functions enumerated below. In another implementation, controller 110 may be hardware-based logic, or may include a combination of hardware, firmware, and/or software elements. Controller 110 may include a memory (not illustrated), which may be any device or component capable of storing digital data, such as one or more integrated circuits of static random access memory (SRAM), dynamic random access memory (DRAM), flash memory, and the like. In some implementations, the memory may be a magnetic or optical disk drive, or other type of storage device. In some embodiments, operations of the method described below may be stored as instructions in the memory or on other non-transitory computer readable media.

Controller 110 includes a reference signal module 120, a motor command module 122, a CMP system output module 124, a sensor input module 126, a lock-in amplifier module 128, and an endpoint analysis module 130. Modules 122, 124, 126, 128, and 130 may be hardware based logic or may be software instructions for execution on a processor to cause the processor to perform the operations described below. Reference signal module 120 is configured to generate a reference signal 132. Reference signal 132 is generated independent of any operations of CMP system 100, and is a repeating pattern that may be used by lock-in amplifier module 128 to remove noise from a signal generated by response sensor 116, as will be described below. In the example provided, reference signal 132 is a sinusoidal waveform having only one frequency. In some embodiments, the reference signal has other shapes or combinations of frequencies.

Motor command module 122 is configured to generate a first signal 134 that includes a motor command with which to command motor 114. For example, the motor command may be based on a desired rotational speed of a semiconductor substrate or a predetermined polishing rate within polishing assembly 112. In some embodiments, first signal 134 is a motor current that achieves the desired rotational speed or predetermined polishing rate.

CMP system output module 124 is configured to generate a second signal 136 using first signal 134 and reference signal 132. In the example provided, the amplitude of reference signal 132 is much smaller than the amplitude of first signal 134. In some embodiments, CMP system output module 124 generates second signal 136 by adding reference signal 132 to first signal 134. In some embodiments, second signal 136 may indicate a current and/or voltage to apply to motor 114.

Sensor input module 126 is configured to receive response signals 138 generated by response sensor 116. Response signal 138 indicates an operational characteristic of polishing assembly 112 that is responsive to input of second signal 136 to motor 114, as will be described below with reference to FIG. 2.

Lock-in amplifier module 128 is configured to filter response signal 138 using reference signal 132. In the example provided, lock-in amplifier module 128 is a lock-in amplifier with response signal 138 and reference signal 132 as inputs and a third signal 140 as an output. Lock-in amplifiers are conventional components in small signal processing, and may also be known as phase-sensitive detectors. Lock-in amplifier module 128 may utilize analog or digital lock-in amplifier techniques, as will be appreciated by those with skill in the art. In some embodiments, alternative components may be utilized to reduce noise in response signal 138 using reference signal 132.

Endpoint analysis module 130 is configured to analyze third signal 140 to determine an endpoint of the CMP process. In the example provided, endpoint analysis module 130 analyzes third signal 140 according to the method described below. In general, endpoint analysis module 130 chooses the endpoint of the CMP process when third signal 140 indicates that a change in material being polished on the semiconductor substrate has been encountered, as will be described below with reference to FIG. 2.

Polishing assembly 112 holds a semiconductor substrate 150 during the CMP process, as will be appreciated by those with skill in the art. Polishing assembly 112 includes a polishing head 152, a polishing platen 154, a polishing pad 156, and a slurry dispenser 158. Polishing head 152 secures semiconductor substrate 150 during the CMP process. Polishing head 152 is coupled for rotation with a rotor of motor 114 to rotate semiconductor substrate 150 relative to polishing pad 156.

Platen 145 secures polishing pad 156 and may be rotated during the CMP process. Polishing pad 156 may include any known polishing pads, as will be appreciated by those with skill in the art. For example, polishing pad 156 may be a polymer-impregnated felt type pad, a porometrics type pad, a filled polymer sheet type pad, an unfilled textured polymer sheet type pad, or other types of pads that may be in use now or in the future. Slurry dispenser 158 dispenses slurry 160 onto polishing pad 156 during the CMP process. It should be appreciated that polishing assembly 112 may take other forms and have additional or alternative components.

Motor 114 is an electrical motor driven by an alternating current power source. In the example provided, motor 114 is a first motor that rotates polishing head 152 using second signal 136. In some embodiments, a second motor 114' is coupled with polishing platen 154. In some embodiments, the second motor 114' may be operated using first signal 134. In other embodiments, the second motor 114' may be operated using second signal 136 when the first motor is operated using first signal 134 or second signal 136.

Response sensor 116 measures an operational characteristic of polishing assembly 112. The operational characteristic may be any operating condition of polishing assembly 112 that changes in response to changes in second signal 136 and a changing friction property of semiconductor substrate 150. In the example provided, response sensor 116 is an angular velocity sensor and the operational characteristic is a velocity of polishing head 152. The angular velocity of polishing head 152 changes in response to the sinusoidal reference signal 132 and changes when the CMP process exposes the underlying material of semiconductor substrate 150, as will be appreciated by those with skill in the art.

Response sensor 116 may measure other conditions or incorporate other technologies. For example, response sensor 116 may be an acoustic sensor that measures an acoustic response of polishing assembly 112. In some embodiments, response sensor 116 may provide feedback directly to motor command module 122 so that CMP process may be controlled to maintain a constant rotational velocity of polishing head 152 and/or polishing platen 154. In such constant rotational velocity embodiments, a current applied to motors 114 may be utilized by controller 110 as an input along with reference signal 132 at lock-in amplifier module 128.

Figure 2:
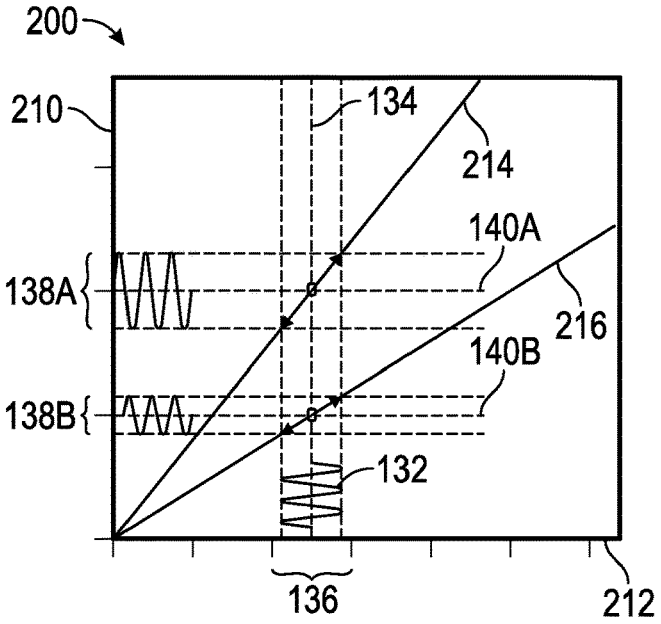
FIG. 2 is a simplified diagram of a response of the CMP system of FIG. 1 to varying inputs in accordance with various embodiments.

Referring now to FIG. 2, a response 200 of polishing assembly 112 to changing input is illustrated in graphical form. A velocity 210 of polishing head 152 is illustrated on the vertical axis and a motor current 212 applied to motor 114 is illustrated on the horizontal axis. A first material response line 214 represents a velocity response of polishing assembly 112 to second signal 136 for a first material subjected to the CMP process. For example, the first material may be the overlying material to be polished from semiconductor substrate 150. A second material response line 216 represents a velocity response of polishing assembly 112 to second signal 136 for a second material subjected to the CMP process. For example, the second material may be the underlying material to be exposed by the CMP process.

As the current applied to motor 114 varies according to reference signal 132 component of second signal 136, the velocity response of polishing assembly 112 varies according to a first velocity response 138A or a second velocity response 138B, depending on the material currently being polished. Controller 110 filters response signal 138A or 138B using reference signal 132 to generate third signal 140A or 140B, depending on the material being polished. In the example provided, controller 110 generates a third signal 140A using first response signal 138A. Controller 110 generates a third signal 140B using second response signal 138B. Controller 110 determines when third signal transitions between third signals 140A and 140B to determine whether the underlying material has been exposed and the CMP process endpoint has been reached, as will be described below.

Figure 3:
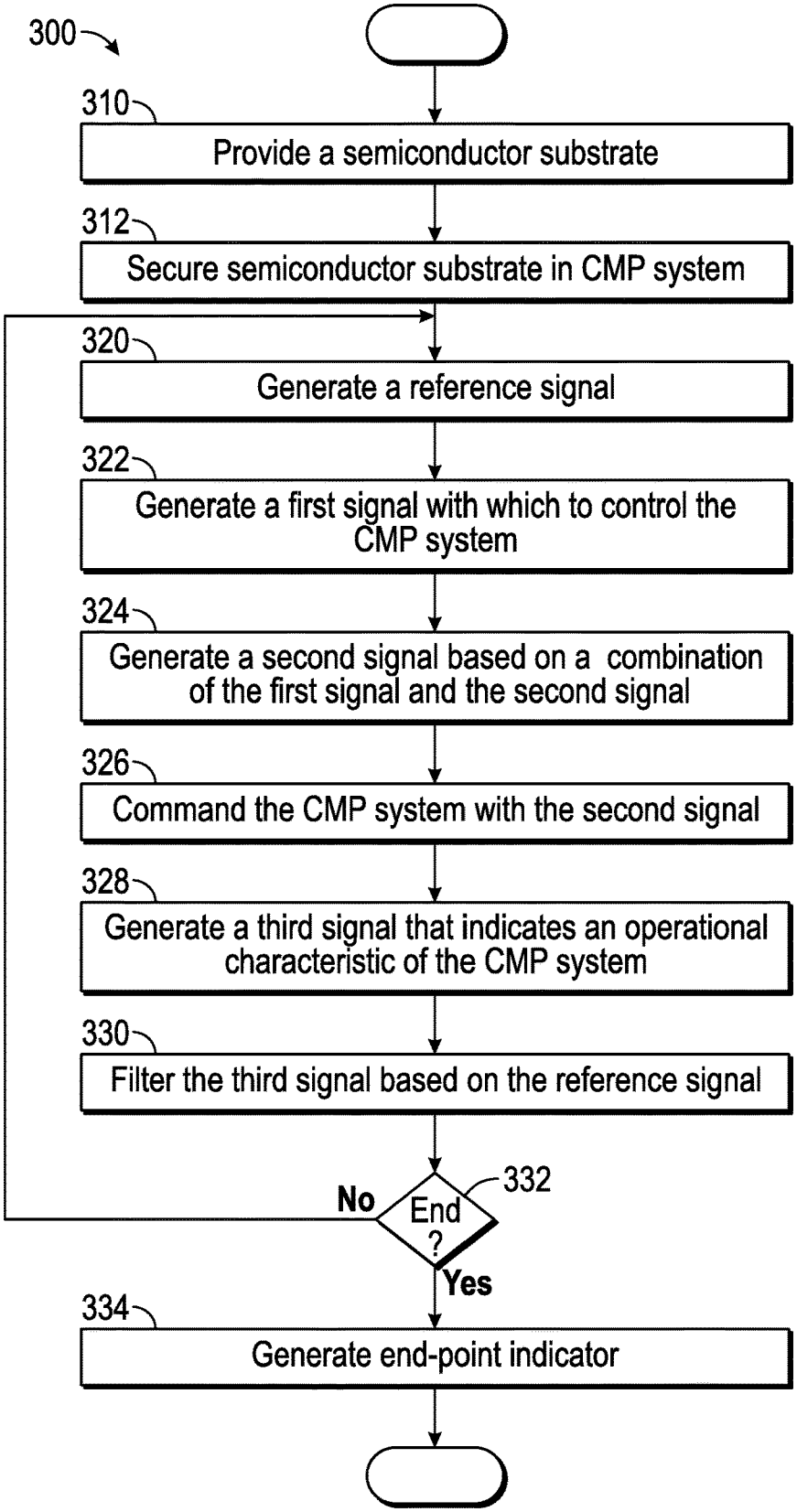
FIG. 3 is a flow diagram for a method of processing a semiconductor substrate in accordance with various embodiments.

Referring now to FIG. 3, a method 300 of fabricating a semiconductor device is illustrated in accordance with some embodiments. In the example provided, various operations of method 300 are performed by controller 110. In some embodiments, operations of method 300 may be governed by instructions that are stored in a non-transitory computer readable storage medium and that are executed by at least one processor of a computing system. In various embodiments, the non-transitory computer readable storage medium includes a magnetic or optical disk storage device, solid state storage devices such as Flash memory, or other non-volatile memory device or devices. The computer readable instructions stored on the non-transitory computer readable storage medium may be in source code, assembly language code, object code, or other instruction format that is interpreted and/or executable by one or more processors.

Operation 310 provides a semiconductor substrate having an exposed first layer of a first material disposed overtop a second layer that is at least partially formed from a second material. For example, the first material may be the material to be polished from semiconductor substrate 150 illustrated in FIG. 1 and may exhibit the first material response line 214 illustrated in FIG. 2. The second material may be the material from semiconductor substrate 150 illustrated in FIG. 1 to be exposed from the CMP process and may exhibit the second material response line 216 illustrated in FIG. 2. In some embodiments, operation 310 is performed by an automated material handling system using commands from controller 110.

Operation 312 secures the semiconductor substrate in a CMP system with the exposed first layer opposing a polishing pad of the CMP system. For example and referring momentarily to FIG. 1, operation 312 may secure semiconductor substrate 150 to polishing head 152 facing polishing pad 156.

Referring again to FIG. 3, operation 320 generates a reference signal. For example and referring momentarily to FIG. 1, controller 110 may generate reference signal 132. It should be appreciated that reference signals with other shapes, frequencies, and amplitudes may be utilized in any particular implementation. Operation 322 generates a first signal with which to control the CMP system. For example and referring momentarily to FIG. 1, controller 110 may generate first signal 134 for motor 114 based on a desired polishing rate of semiconductor substrate 150. The desired polishing rate may be commanded with a motor current that was experimentally determined using prior experiments, or may be calculated using known factors, as will be appreciated by those with skill in the art. In some embodiments, first signal 134 indicates a rotational velocity of polishing head 152 to be maintained using feedback from sensor 116.

Referring again to FIG. 3, operation 324 generates a second signal using a combination of the first signal and the reference signal. For example and referring momentarily to FIG. 1, controller 110 may generate second signal 136 using reference signal 132 and first signal 134. In the example provided, the combination is a simple addition of reference signal 132 to first signal 134. In some embodiments, the combination may be based on alternative computations.

Referring again to FIG. 3, operation 326 commands the CMP system with the second signal. For example and referring momentarily to FIG. 1, controller 110 may command motor 114 with second signal 136. Operation 328 generates a third signal that indicates an operational characteristic of the CMP system. The operational characteristic is responsive to commanding the CMP system with the second signal and is responsive to a friction property of the semiconductor substrate. For example, sensor 116 may generate response signal 138 indicating a velocity response of polishing assembly 112 to second signal 136. As described above with reference to FIG. 2, response signal 138 varies based on second signal 136 and the material being polished.

Referring again to FIG. 3, operation 330 filters the third signal using the reference signal to determine the endpoint of the CMP process. For example and referring momentarily to FIG. 1, controller 110 may filter response signal 138 using lock-in amplifier module 128 and reference signal 132 to generate third signal 140. Third signal 140 has a value that resembles first response signal 138A or second response signal 138B with the variations due to reference signal 132 removed during the lock-in amplifier filtering.

Referring again to FIG. 3, operation 332 determines whether the filtered third signal indicates the endpoint of the CMP process. For example, endpoint analysis module 130 may determine whether third signal 140 has transitioned from third signal 140A to third signal 140B to determine whether the CMP process has encountered a change in material being polished. When controller 110 determines that a material being polished has changed, then controller 110 indicates that the endpoint has been reached. When the endpoint has been reached, controller 110 generates an endpoint indicator signal in operation 334. When the endpoint has not been reached, controller 110 returns to operation 320 to continue the CMP process.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for detecting an endpoint of a chemical mechanical planarization (CMP) process on a semiconductor substrate, the method comprising:

generating a first signal configured to command a motor of a CMP system;

generating a reference signal that is independent of operations of the CMP system and of the motor;

generating a second signal as a combination of the first signal and the reference signal;

commanding the motor with the second signal;

generating a response signal that indicates an operational characteristic of the CMP system that is responsive to the second signal and a friction property of the semiconductor substrate; and filtering the response signal using the reference signal to determine an endpoint of the CMP process.

2. The method of claim 1, wherein filtering the response signal includes filtering the response signal using a lock-in amplifier with the reference signal and the response signal as inputs.

3. The method of claim 1, wherein filtering the response signal further comprises calculating a change in a material being polished during the CMP process.

4. The method of claim 3, wherein calculating the change in the material being polished uses an acoustic response of the CMP system to commanding the motor with the second signal.

5. The method of claim 1, wherein generating the first signal further includes generating a motor command configured to control the motor, and wherein the motor is coupled with one of a platen and a polishing head of the CMP system.

6. The method of claim 5, wherein generating the response signal includes indicating a velocity of the one of the platen and the polishing head.

7. The method of claim 5, wherein generating the motor command is based on maintaining a substantially constant velocity for the one of the platen and the polishing head using feedback from a velocity sensor.

8. The method of claim 7, wherein filtering the response signal includes calculating changes in a motor current indicated by the motor command using a lock-in amplifier and the reference signal to detect the endpoint.

* * * * *